US006991493B2

(12) United States Patent
Matsui et al.

(10) Patent No.: US 6,991,493 B2
(45) Date of Patent: Jan. 31, 2006

(54) SHIELDED WIRE-CONNECTING STRUCTURE

(75) Inventors: Tsuyoshi Matsui, Toyota (JP); Hideomi Adachi, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/970,729

(22) Filed: Oct. 22, 2004

(65) Prior Publication Data

US 2005/0118858 A1 Jun. 2, 2005

(30) Foreign Application Priority Data

Oct. 24, 2003 (JP) ..... P2003-364520

(51) Int. Cl.
*H01R 9/05* (2006.01)

(52) U.S. Cl. ..... 439/579; 439/98

(58) Field of Classification Search ..... 439/579, 439/497, 98, 610; 174/51

See application file for complete search history.

(56) References Cited

U.S. PATENT DOCUMENTS 4,201,433 A * 5/1980 Caldwell ..... 439/98
4,502,743 A * 3/1985 Ziegler ..... 439/98
5,174,768 A * 12/1992 Hewison et al. ..... 439/95
5,429,532 A * 7/1995 Auclair ..... 439/793
6,042,396 A * 3/2000 Endo et al. ..... 439/98
6,398,563 B1 * 6/2002 Kanagawa et al. ..... 439/98
6,648,690 B2 * 11/2003 Saito et al. ..... 439/610
6,669,511 B1 * 12/2003 Yagi et al. ..... 439/610
6,727,430 B1 * 4/2004 Franks, Jr. ..... 174/51

FOREIGN PATENT DOCUMENTS

JP 6-58560 U 8/1994
JP 7-193966 A 7/1995
JP 2000-184556 A 6/2000
JP 2002-117947 A 4/2002

* cited by examiner

*Primary Examiner*—Gary Paumen
(74) *Attorney, Agent, or Firm*—Sughrue Mion, PLLC

(57) ABSTRACT

In a shielded wire-connecting structure, a braided wire 37*c* of a shielded wire 37 is connected for grounding purposes to a shield shell 25 via a joint terminal 10, 15 which includes a wire connection portion 13 formed at one end thereof so as to be connected to the braided wire 37*c*, and a terminal mounting portion formed at the other end thereof so as to be connected to the shield shell 25. A passage hole for the passage of a fastening bolt 19 therethrough is formed through the terminal mounting portion, and the terminal mounting portions of a plurality of the joint terminals 10 and 15 are superposed together, with the passage holes communicating with each other, and are fastened together to the shield shell 25 by the fastening bolt 19 passing through the passage holes. A retaining step portion is formed at one of the terminal mounting portions which are to be superposed together, and an engagement step portion for engagement with the retaining step portion is formed at the other terminal mounting portion.

4 Claims, 5 Drawing Sheets

SHIELDED WIRE-CONNECTING STRUCTURE

BACKGROUND OF THE INVENTION

1. Field of the Invention

This invention relates to a shielded wire-connecting structure which is used in an electric car or the like, and causes electromagnetic waves, transmitting along a shielded wire, to escape to the exterior, and also to block electromagnetic waves from the exterior so as to eliminate adverse effects of such electromagnetic waves on an equipment.

2. Related Art

Many equipments, such as a motor, are mounted on a vehicle (serving as a mobile structure) such as an automobile, and adverse effects of electromagnetic waves, generated from these equipments and wires, have now been at such a level that these effects can not be ignored. Particularly, adverse effects of electromagnetic waves, generated from large-current/high-voltage equipments, have become a problem. Therefore, the equipments and wires have been protected from electromagnetic interference by the use of a suitable method such as an electromagnetic shielding method although the countermeasures are different depending on the source of generation of electromagnetic waves and the kind of electromagnetic waves.

A wire having a shielding layer provided around its conductor, that is, a so-called shielded wire (or shielded cable), has been extensively used as a wire for supplying electric power to an on-vehicle equipment and also as a wire for transmitting and receiving signals. Particularly, a wire, having a thin design for lightweight purposes, is liable to be affected by electromagnetic waves, and a shielded wire has been used as such a wire.

FIG. 6 is one example of the art related to a structure of connecting a shielded wire of this kind shown in Unexamined Utility Model Publication Hei. 6-58560. This shield connector 100 includes a shielded wire 122, a metal terminal 115 of a cylindrical shape press-fastened to an end portion of the shielded wire 122, and an insulative connector housing 101 having a terminal receiving chamber 106.

The shielded wire 122 includes a conductor 122*a* provided at a center or axis thereof, a braided wire 122*c* provided around the conductor 122*a* through an inner insulating covering 122*b*, and an outer insulating sheath 122*d* forming an outermost layer. The metal terminal 115 is a so-called round pin formed by cutting a material of copper or a copper alloy. An electrical contact portion 117, having a bolt hole 117*a*, is formed at a front half of this metal terminal 115, while a wire connection portion 119, having a conductor insertion hoe 119*a*, is formed at a rear half thereof, and the two portions 117 and 119 are separated from each other by a partition wall 116 formed at a central portion of the metal terminal. An equipment-side terminal 127, press-fastened to a power connection cable 126 of an on-vehicle equipment, is fastened to the electrical contact portion 117 by a fastening bolt 130.

An end portion of the conductor 122*a*, exposed by removing the inner insulating covering 122*b*, is inserted into the conductor insertion hole 119*a* in the metal terminal 119, and is fixedly connected to the wire connection portion 119 by press-deforming this wire connection portion 119. A waterproof rubber plug 131 is fitted on an end portion of the braided wire 122*c* exposed by removing the outer insulating sheath 122*d*. A rubber plug holder 132 is fitted on the insulated wire, and is disposed at a rear side of the waterproof rubber plug 131. A connecting member 112 of an electrically-conductive nature is provided at the front side of the waterproof rubber plug 131, and is held in contact with the braided wire 122*c*.

The connector housing 101 includes a cylindrical housing body 105, a shield shell 110 which is integrally molded in the housing body 105, and serves also as a grounding contact, and a flange portion 111 formed on and around an outer surface of the shield shell 110.

The housing body 105 has the terminal receiving chamber 106 having open opposite ends, and an outer wall of the housing body 105 is divided into a front half reduced-thickness portion and a rear half thickened portion, with a stepped portion formed at the boundary between the reduced-thickness portion and the thickened portion. The flange portion 111 is formed at the stepped portion over an entire periphery thereof, and is disposed perpendicularly to the outer wall.

The shield shell 110 has a generally L-shape or inverted L-shape as a whole, and includes a cylindrical tubular portion 110*a*, and a flange 110*b* extending generally perpendicularly from one end of the tubular portion 110*a*. The tubular portion 110*a* is integrally molded in the outer wall of the housing body 105 as described above. A distal end portion of the tubular portion 110*a* is resiliently contacted with the connecting member 112 resiliently supported on the waterproof rubber plug 131. The flange 110*b* for grounding purposes is exposed at the front side of the flange portion 111, and is held between a casing 125 and the flange portion 111.

The casing 125 is an electrically-conductive wall portion of the on-vehicle equipment such as a motor, and this casing 125 has a mounting hole 125*a* for the connector housing 101, and also has bolt holes 125*b* for the flange portion 111. The flange 110*b* of the shield shell 110 is held between the casing 125 and the flange portion 111, and then bolts 121 (serving as fastening members) are inserted respectively into the bolt holes 125*b*, and by doing so, the flange 110*b* and the casing 125 are held in contact with each other, thereby connecting the shielded wire 122 to the ground.

Another conventional example is a shielded wire-connecting structure using the fitting connection between male and female connectors Unexamined Japanese Patent Publication 2002-117947. In this conventional example, the connection of wire to a base wall for grounding purposes can be effected stably without incurring a permanent set, wear, etc., of a resilient contact portion, and a good shielding performance can be maintained, and also the shielding performance can be enhanced. A shield shell, joint terminals, an outer housing and a flange portion are formed of a non-magnetic material having electrical conductivity. The joint terminal is provided in contact with a connector entry-side inner wall surface of the outer housing, the shield shell is provided at the male connector, and the shield shell is connected at one side portion to braided wires of shielded wired, and is connected at the other side portion to the joint terminals, and the flange portion of the outer housing is fixedly connected by bolts to a electrically-conductive connector mounting wall of an equipment.

With respect to other conventional examples, there is known a structure in which a shield connector is covered with an electrically-conductive cover, and an electrically-conductive grommet is mounted on a distal end portion of a shielded wire in intimately-contacted relation thereto, and with this construction the connection of the shielded wire can be effected easily, and a waterproof performance is enhanced as shown in Unexamined Japanese Patent Publication Hei. 7-193966. There is also known a structure in which shielded wires, introduced from the exterior via respective grommets, are connected to a non-waterproof joint connector located within an auxiliary equipment box of a sealed structure, and with this construction the processing of the shielded wires can be effected easily as shown in Unexamined Japanese Patent Publication 2000-184556.

However, the above conventional shielded wire-connecting structures have the following problems to be solved.

In the first conventional example, when a plurality of shielded wires 122 were to be connected to the equipment, the casing 125 was required to have a large area to which the flange 110*b* of the shield shell 110 was to be connected, and therefore there was encountered a problem that the shield connector 100 could not be mounted on the casing.

And besides, the metal terminal 115, having the electrical contact portion 117 at one side of the partition wall 116 and the wire connection portion 119 at the other side of the partition wall, was received in the shield connector 100, and therefore the overall length of the shield connector 100 was large, and this invited a problem that the shield connector 100 had a large size. Particularly in the case of a multi-pole shield connector receiving a plurality of terminals, the number of component parts was large, and therefore the shield connector became unduly large, and in some cases, the shield connector could not be easily mounted on an equipment installed in a smaller space, for example, under a floor.

The flange 110*b* of the shield shell 110 and the bolt 130 were exposed to the outside of the casing 125, and therefore there was a fear that these were corroded by water, intruding from the exterior, and dew condensation, so that the shielding performance was adversely affected.

In the second conventional example, the connection between the shielded wire and the equipment was effected by the connector-connection between the male and female connectors, so that the connection could be effected with a one-touch operation. However, the connecting structure was complicated, and increased in size, so that the shield connector could not be easily mounted in a limited mounting space, thus inviting a problem that the efficiency of the mounting operation was low.

In the third conventional example, the waterproof grommet was mounted on each shielded wire, and therefore when a plurality of shielded wires were used, the shielded wire-connecting structure became complicated, thus inviting a problem that the structure became large in size.

In the fourth conventional example, the connector was connected to the end portions of the shielded wires introduced into the auxiliary box via the respective grommets, and therefore as in the first conventional example, there was encountered a problem that the number of the component parts was large, so that the shielded wire-connecting structure became large in size.

SUMMARY OF THE INVENTION

In view of the foregoing, it is an object of this invention to provide a shielded wire-connecting structure in which the connecting structure can be formed into a compact design, and besides each shielded wire can be connected to the ground without requiring an undue operation space, and furthermore a waterproof performance of a connected portion between each shielded wire and an equipment can be enhanced.

A first object has been achieved by a shielded wire-connecting structure of the present invention wherein a braided wire of a shielded wire is connected for grounding purposes to a shielding cover via a joint terminal which includes a wire connection portion formed at one end thereof so as to be connected to the braided wire, and a terminal mounting portion formed at the other end thereof so as to be connected to the shielding cover; provided in that a passage hole for the passage of a fastening member therethrough is formed through the terminal mounting portion, and the terminal mounting portions of a plurality of the joint terminals are superposed together, with the passage holes communicating with each other, and are fastened together to the shielding cover by the fastening member passing through the passage holes.

In the above construction, when the braided wire of each shielded wire is connected to the shielding cover via the joint terminal, and the shielding cover is fixed to a grounding portion of an equipment, electromagnetic waves, transmitting along the shielded wire, are grounded to the equipment, so that adverse effects of the electromagnetic waves on the equipment are eliminated. When the shielded wire is covered with the shielding cover, external electromagnetic waves are prevented from propagating to the equipment by radiation and conduction, and this also eliminates adverse effects of the electromagnetic waves on the equipment. The terminal mounting portions of the plurality of joint terminals are superposed together, and with this arrangement the area of contact of the terminal mounting portions with the shielding cover is reduced.

According to a second aspect of the present invention, there is provided a shielded wire-connecting structure wherein a braided wire of a shielded wire is connected for grounding purposes to a grounding portion of an equipment via a joint terminal which includes a wire connection portion formed at one end thereof so as to be connected to the braided wire, and a terminal mounting portion formed at the other end thereof so as to be connected to the grounding portion; provided in that a passage hole for the passage of a fastening member therethrough is formed through the terminal mounting portion, and the terminal mounting portions of a plurality of the joint terminals are superposed together, with the passage holes communicating with each other, and are fastened together to the grounding portion by the fastening member passing through the passage holes.

In the above construction, the terminal mounting portions of the plurality of joint terminals are superposed together, and with this arrangement the area of contact of the terminal mounting portions with the grounding portion of the equipment is reduced. And besides, the braided wires can be connected for grounding purposes to the equipment before mounting the shielding cover which covers the connected portion between each shielded wire and the equipment.

The shielded wire-connecting structure of a third aspect of the present invention, depending from the first or second aspect of the present invention is provided in that a retaining portion is formed at one of the terminal mounting portions which are to be superposed together, and an engagement portion for engagement with the retaining portion is formed at the other terminal mounting portion.

In the above construction, the retaining portion and engagement portion of the superposed terminal mounting portions are engaged with each other, and by doing so, the joint terminals can be beforehand combined together. And besides, even when an unnecessary pulling force acts on the shielded wire, the superposed joint terminals are prevented from being disengaged from the shielding cover or the grounding portion.

The shielded wire-connecting structure of a fourth aspect of the present invention, depending from any one of the first to third aspect of the present invention, is provided in that the joint terminal is bent into a generally L-shape.

In the above construction, the joint terminals are prevented from projecting outwardly, and any special processing does not need to be applied to the shielding cover.

As described above, in the first aspect of the present invention, the plurality of joint terminals are superposed together, and are fastened together to the shielding cover, and therefore the shielded wire-connecting structure can be formed into a compact design, and the area of contact of the terminal mounting portions with the shielding cover is reduced, and the shielded wires can be connected to the equipment even in a narrow mounting space.

In the second aspect of the present invention, the terminal mounting portions of the plurality of joint terminals are superposed together, and therefore the area of contact of the terminal mounting portions with the grounding portion of the equipment is reduced. And besides, after the braided wires are connected for grounding purposes to the equipment, and conductors of the shielded wires are electrically connected to the equipment, the shielding cover is mounted to cover the connected portion between each shielded wire and the equipment. Therefore, the shielded wire-connecting structure can be formed into a compact design, and the shielded wire-connecting operation can be carried out even in a narrow mounting space. And besides, the efficiency of the operation for connecting the shielded wires to the equipment is enhanced.

In the third aspect of the present invention, the retaining portion and engagement portion of the superposed terminal mounting portions are engaged with each other, and by doing so, the joint terminals can beforehand be combined together. Therefore, the operator does not need to pass the fastening member through the passage holes in the terminal mounting portions while aligning these passage holes with each other, and the mounting of the joint terminals on the shielding cover or the grounding portion of the equipment can be effected easily.

In the fourth aspect of the present invention, the joint terminal is bent into a generally L-shape, and therefore the joint terminals are prevented from projecting outwardly, and any special processing does not need to be applied to the shielding cover. Therefore, similar effects to those of the first aspect of the present invention are achieved, and besides the shielded wire-connecting structure can be formed into a compact design, the shielded wires can be connected to the equipment even in a narrow mounting space.

DETAILED DESCRIPTION OF THE PREFERRED EMBODIMENTS

Preferred embodiments of the present invention will now be described in detail with reference to the drawings.

Figure 1:
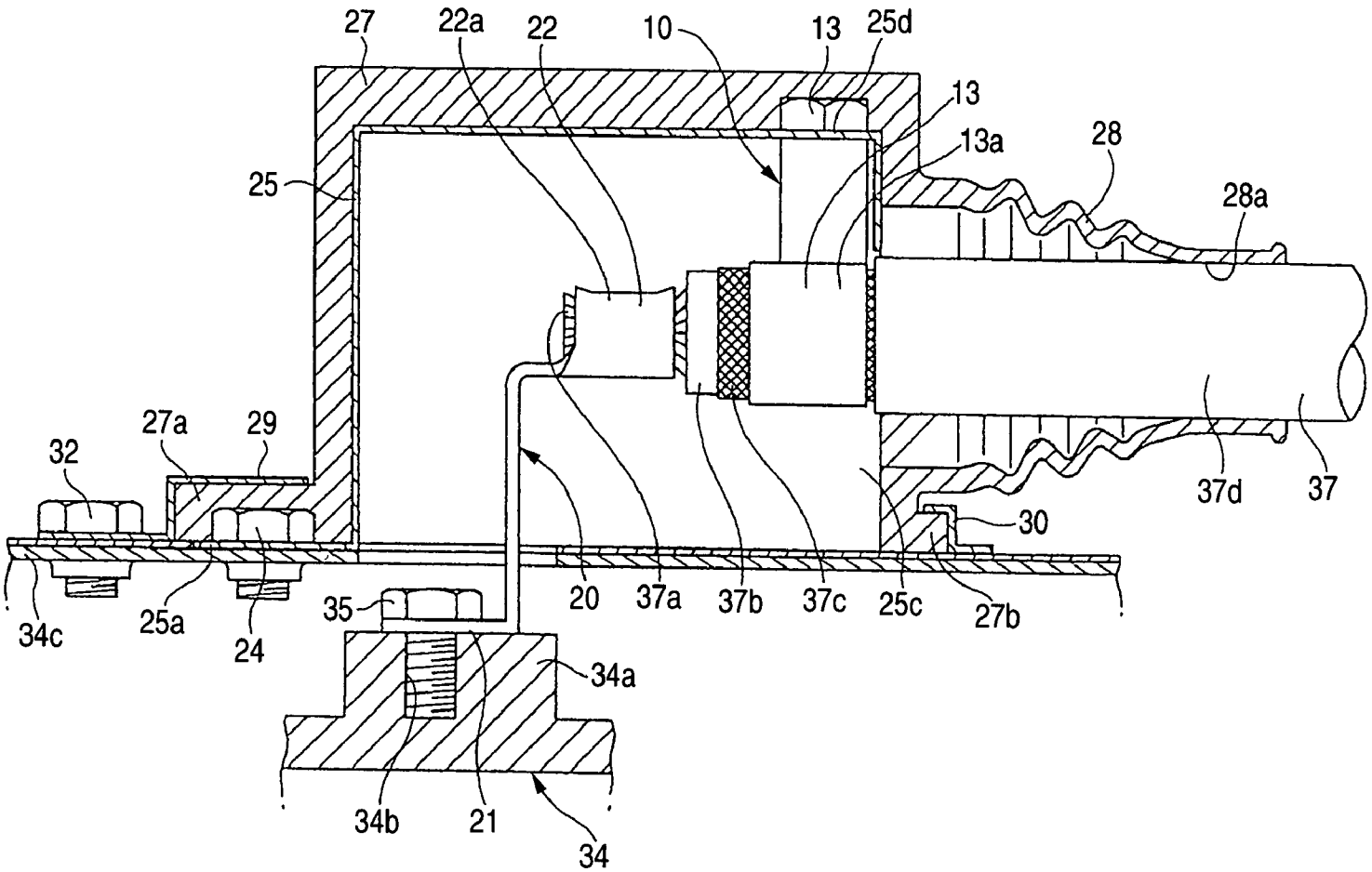
FIG. 1 is a cross-sectional view of a first embodiment of a shielded wire-connecting structure of the invention.
Figure 2:
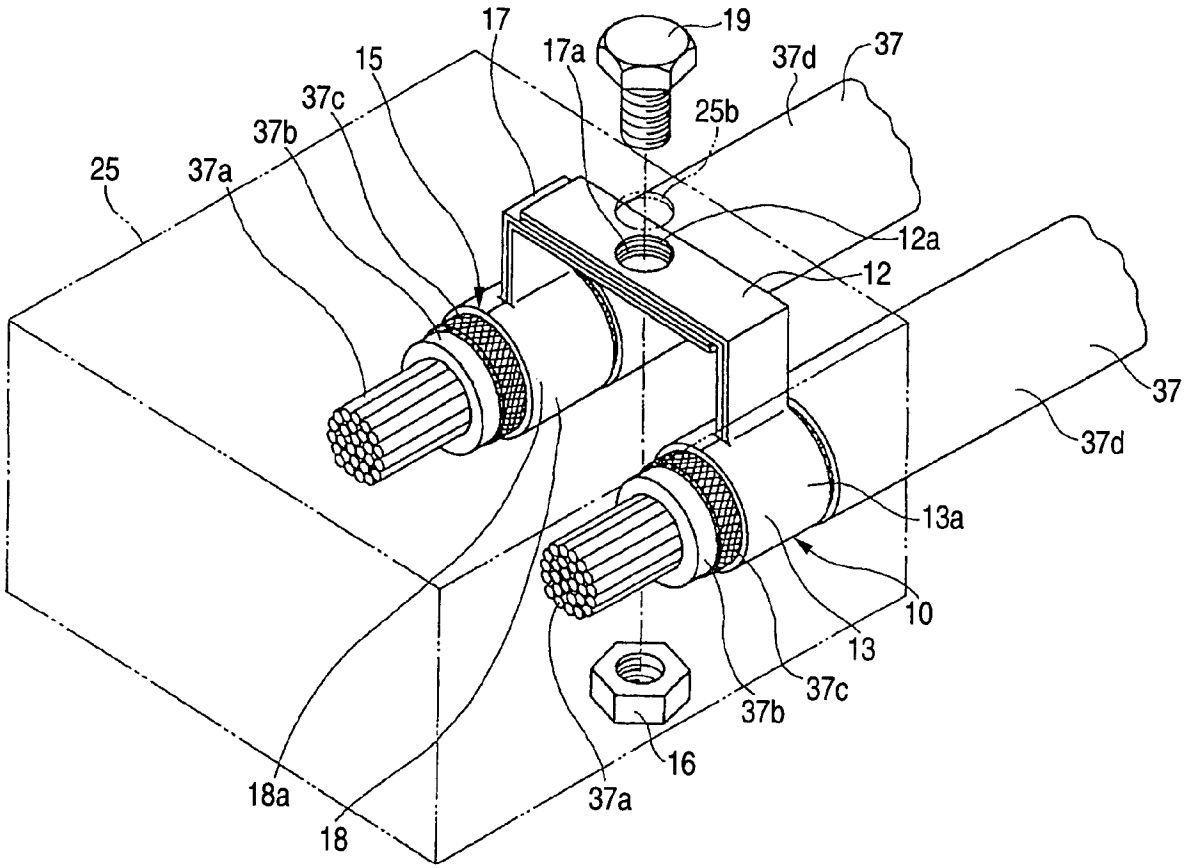
FIG. 2 is a perspective view showing a condition in which terminal mounting portions of joint terminals of FIG. 1 are superposed together.
Figure 3:
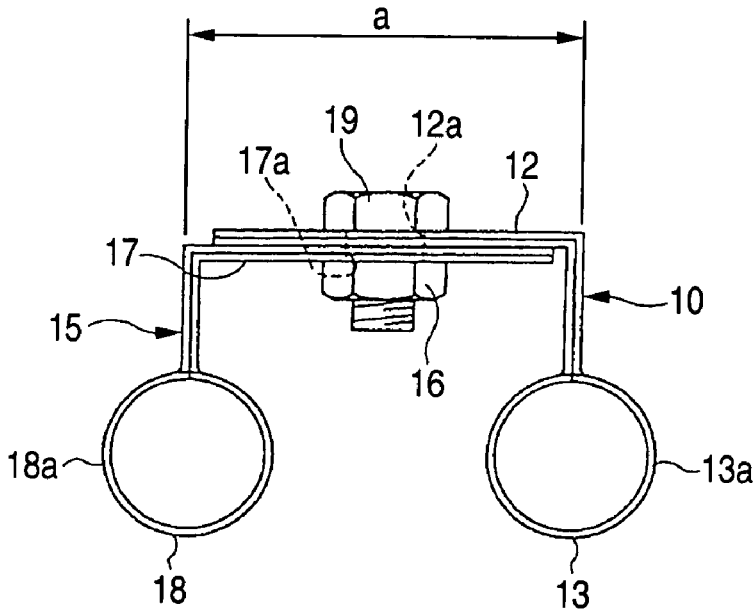
FIG. 3 is a front-elevational view showing the condition in which the terminal mounting portions of the joint terminals are superposed together.
Figure 4:
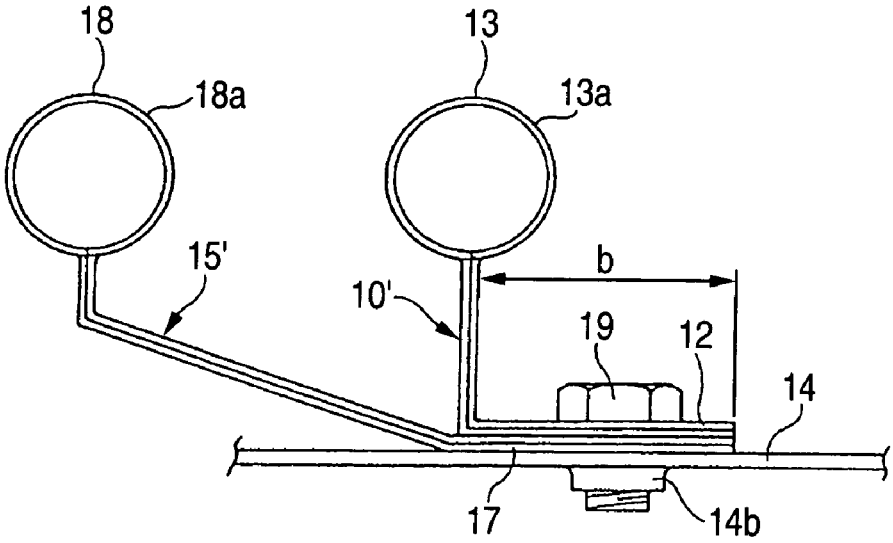
FIG. 4 is a front-elevational view showing a modified example of the shielded wire-connecting structure of the invention.
Figure 5:
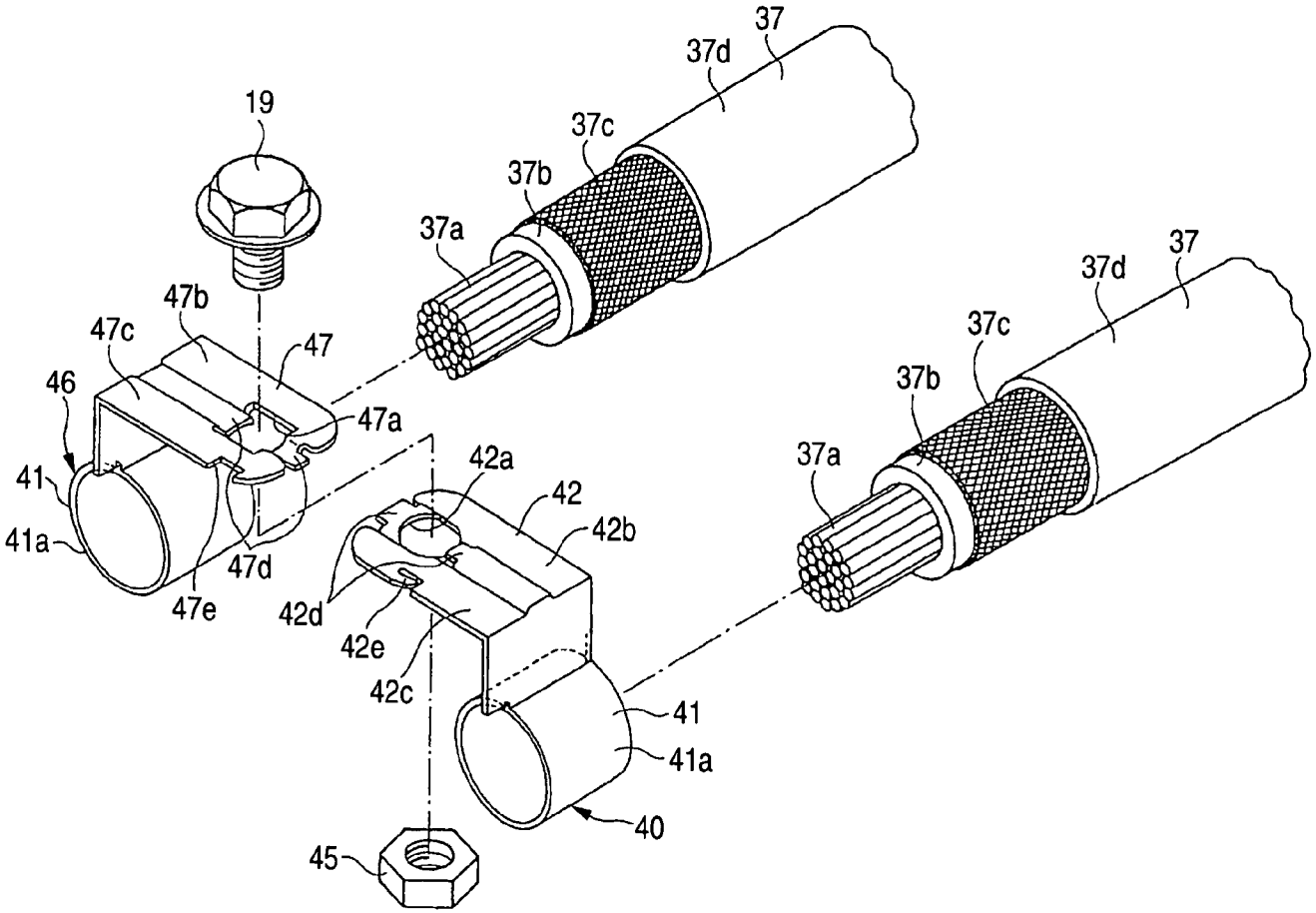
FIG. 5 is a perspective view showing a second embodiment of a shielded wire-connecting structure of the invention.

FIGS. 1 to 3 show a first embodiment of a shielded wire-connecting structure of the invention, and FIG. 4 shows a modified example thereof, and FIG. 5 shows a second embodiment.

Adverse effects of electromagnetic waves on an actuator (equipment), such as a motor, an inverter, an electronic control unit and a fuel injection device, mounted on an electric car, have now been at such a level that these effects can not be ignored. The shielded wire-connecting structure of the invention is designed to protect such an actuator from electromagnetic interference, that is, mainly from high-frequency electric and magnetic fields, to prevent a malfunction, thereby maintaining a safe travel of the car for a long period of time.

In the shielded wire-connecting structure of this embodiment, this connecting structure can be formed into a compact design, and besides the efficiency of an operation for connecting shielded wires to an actuator can be enhanced. The structure of connecting the shielded wires 37 comprises the shielded wires 37 each including a conductor 37*a* and a braided wire 37*c* provided around the conductor 37*a*, and a shield shell (shielding cover) 25 for shielding end portions of the shielded wires 37. This shielded wire-connecting structure is provided mainly in that the braided wires 37*c* of the shielded wires 37 are connected to the shield shell 25 respectively via joint terminals 10 and 15, each of the joint terminals 10 and 15 including a wire connection portion 13, 18 formed at one end thereof so as to be press-fastened to the braided wire 37*c*, and a terminal mounting portion 12, 17 formed at the other end thereof so as to be fixedly fastened to the shield shell 25, that a passage hole 12*a*, 17*a* for the passage of a fastening bolt (fastening member) 19 therethrough is formed through the terminal mounting portion 12, 17, and that the plurality of joint terminals 10 and 15 are superposed together, with the passage holes 12*a* and 17*a* communicating with each other, and are fastened together to the shield shell 25 by the fastening bolt 19 passing through the passage holes 12*a* and 17*a*.

The main constituent portions of the shielded wire-connecting structure, as well as their operations, will be described below in detail. FIG. 1 shows the connecting structure for the shielded wires 37 connected to a motor 34 mounted under a floor of an electric car. The two shielded wires 37 and 37 are connected to the motor 34. Incidentally, the present invention can be applied to a three-phase AC motor operated by three single-phase currents. In the case where there are provided three shielded wires 37, the terminal mounting portions 12 and 17 of the joint terminals 10 and 15 can be fastened together to the shield shell 25 as is the case with the structure using the two shielded wires 37.

The shielded wire (or shielded cable) 37 is of a four-layer construction, and includes the conductor (or core wire) 37*a* provided at the center or axis thereof, the braided wire 37*c* provided around the periphery of the conductor 37*a* through an inner insulating covering 37*b*, and an outer insulating sheath 37*d* provided around the periphery of the braided wire 37*c*. Therefore, in the shielded wire 37, the conductor 37*a*, the inner insulating covering 37*b*, the braided wire 37*c* and the outer insulating sheath 37*d* are arranged coaxially sequentially from the inner side.

A constituent material for the conductor 37*a* is not particularly limited, and any suitable known conductive material can be used. For example, a soft copper wire, a tinned copper wire, a nickel-plated copper wire or the like can be used. The metal-plated copper wires are enhanced in corrosion resistance and heat resistance, and also are protected against reaction with the insulating covering (or coating) 37*b*, and therefore have an advantage that their electrical properties can be maintained for a long period of time.

The inner insulating covering 37*b* and the outer insulating sheath 37*d* are made of a polymeric material such as a polyvinyl chloride resin, a polyethylene resin and a polypropylene resin. Depending on the kind of the resin material, a plasticizer is added, or a crosslinking treatment is applied.

The braided wire 37*c* is made of a tinned soft copper wire or the like having an excellent shielding performance, and this braided wire is formed by weaving wire elements into a tubular shape. The braided wire is stretchable, and can be easily turned back along the inner insulating covering 37*b*.

At the end portion of the shielded wire 37, the inner insulating covering 37*b* is removed over a predetermined length to expose the conductor 37*a*, and also the outer insulating sheath 37*d* is removed over a predetermined length to expose the braided wire 37*c*. A wire connection portion 22 of an LA terminal 20 is press-fastened to the conductor 37*a*, and the wire connection portion 13, 18 of the joint terminal 10, 15 is press-fastened to the braided wire 37*c*.

The LA terminal 20 is formed by blanking a piece from an electrically-conductive sheet and then by bending it into a crank-shape. This LA terminal is known as an automotive eyelet terminal of JIS D5403. In the present invention, the LA terminals 20 can be replaced by LE terminals (automotive spade terminals).

A terminal mounting portion 21 for being fixedly fastened to the motor 34 is formed at one end of the LA terminal 20, while the wire connection portion 22 for being fastened to the conductor 37*a* of the shielded wire 37 is formed at the other end thereof. A passage hole is formed through the terminal mounting portion 21 at the center thereof, and this passage hole is aligned with a hole 34*b* formed in an electrode portion 34*a* of the motor 34, and in this condition a fastening bolt 35 is tightened, thereby connecting the terminal mounting portion 21 to the motor 34. The wire connection portion 22 has a pair of opposed press-clamping piece portions 22*a* and 22*a*, and these press-clamping piece portions 22*a* and 22*a* are press-deformed inwardly toward each other to be press-fastened to the conductor 37*a*.

Figure 6:
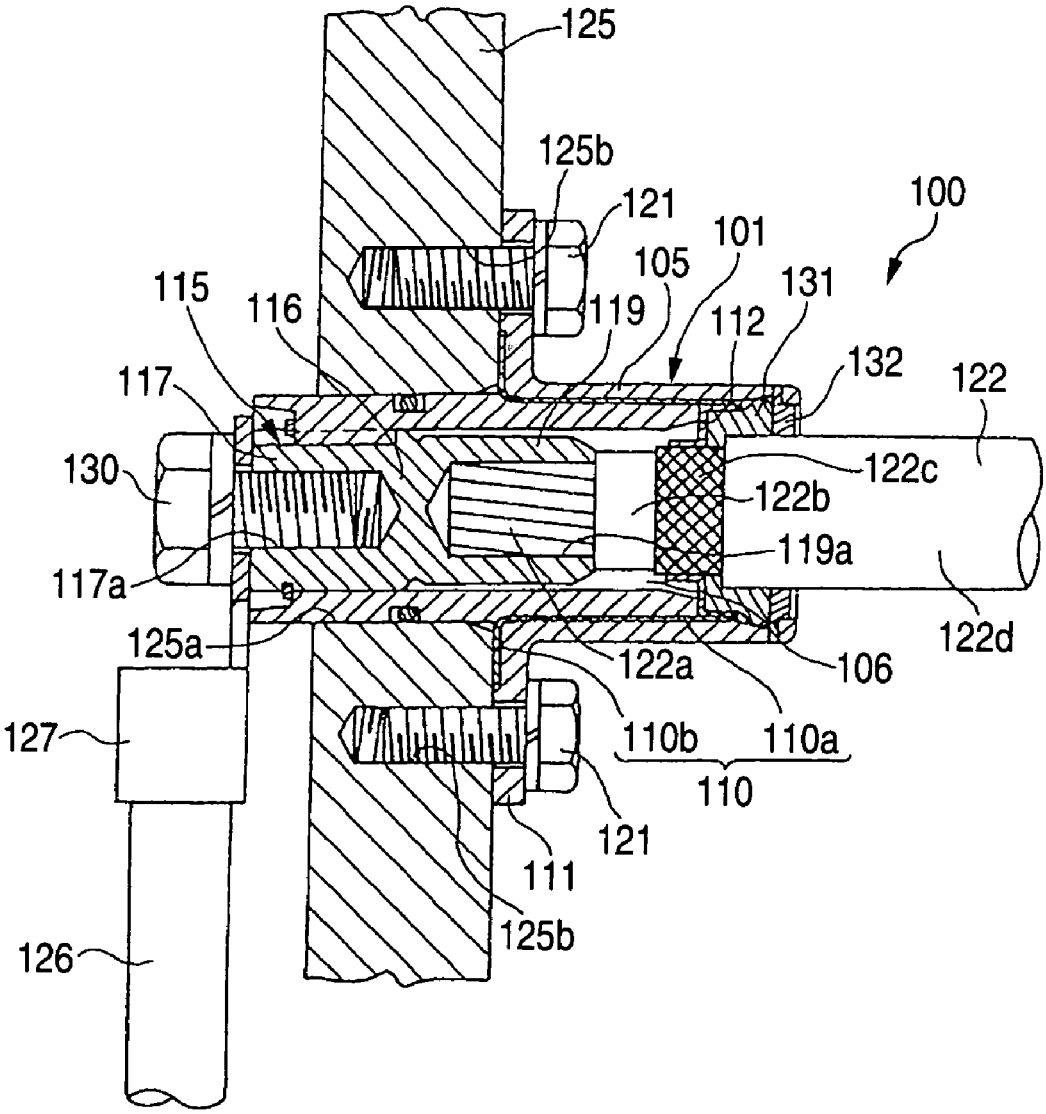
FIG. 6 is a cross-sectional view showing one example of conventional shielded wire-connecting structures.

The conventional metal terminal 115, shown in FIG. 6, is the pin-like terminal formed by cutting a material, and therefore is longer than the LA terminal 20 of this embodiment, and hence had a problem that the overall length of the shield connector 100 became large. In this invention, however, the LA terminals 20, bent into a crank-shape, are used, and this also enables the compact design of the connecting structure for the shielded wires 37.

Each of the joint terminals 10 and 15 is formed by blanking a piece from an electrically-conductive sheet and then by folding it double and then by bending it into an L-shape, thereby providing an integral construction (FIGS. 2 and 3). The joint terminals 10 and 15 are thus formed into an L-shape, and therefore are prevented from projecting outwardly from the motor 34, and any special processing does not need to be applied to the shield shell 25.

The wire connection portion 13, 18 for connection to the braided wire 37*c* of the shielded wire 37 is formed at one end of the joint terminal 10, 15, while the terminal mounting portion 12, 17 for connection to the shield shell 25 is formed at the other end thereof. The wire connection portion 13, 18 has a tubular shape, and is inwardly press-deformed uniformly over an entire periphery thereof to be press-fastened to the braided wire 37*c*. The terminal mounting portion 12, 17 has a plate-like shape, and has the passage hole 12*a*, 17*a* for the passage of a shank portion of the fastening bolt 19. The joint terminals 10 and 15, connected to the plurality of shielded wires 37, are superposed together with the passage holes 12*a* and 17*a* (formed respectively through the terminal mounting portions 12 and 17) communicating with each other, and the joint terminals 10 and 15 are fastened together to the shield shell 25 by tightening the fastening bolt 19 passing through the passage holes 12*a* and 17*a*.

As shown in FIG. 3, an operation space a, required for fastening the terminal mounting portions 12 and 17 by the common bolt to the shield shell 25, is smaller than an operation space which would be needed in the case where the terminal mounting portions 12 and 17 are not fastened together to the shield shell 25, but are fastened to the shield shell 25 separately from each other by respective bolts. Therefore, the bolt can be fastened in the narrow limited space near to the motor 34.

The shield shell 25 is formed by blanking a piece from a non-magnetic and electrically-conductive aluminum alloy sheet and then by bending it. The constituent material of the shield shell 25 is not limited to such an aluminum alloy, but any other suitable material, such for example as a copper alloy and a synthetic resin material having an electrically-conductive coating formed thereon, can be used in so far as it has excellent shielding properties. Steel is not preferred since its shielding performance is low. A synthetic resin material, not subjected to any treatment, is not suitable since it allows electromagnetic waves to transmit therethrough.

The shield shell 25 covers the end portions of the shielded wires 37 and the electrode portions 34*a* of the motor 34 to shield these portions to prevent electromagnetic waves from being transmitted from the exterior to the motor 34. A fixing portion 25*a* is formed at a front side of the shield shell 25, and this fixing portion 25*a* is bolt-fastened to an earth cover 34*c* of the motor 34. A fixing portion 25*d*, having a hole 25*b* (through which the joint terminals 10 and 15 are fastened together to the shield shell), and an opening 25*c* (through which the shielded wires 37 are inserted), continuous with the fixing portion 25*d*, are formed at a rear portion of the shield shell (FIG. 1).

A grommet 27 is an elastic member of an insulating nature for waterproof purposes, and by injection molding, this grommet is integrally molded into such a shape as to cover the outside of the shield shell 25. A fixing member 29 is held against a flange portion 27*a* formed at a front side of the grommet 27, and in this condition this fixing member 29 is fixed to the earth cover 34*c* by bolts. Similarly, a fixing member 30 is held against a rear flange portion 27*b* of the grommet 27, and in this condition this fixing member 30 is fixed to the earth cover 34*c*.

Those potions of the shielded wires 37, disposed outwardly of the shield shell 25, extend respectively through bellows portions 28 of the grommet 27 to the exterior of the grommet 27. A mouth portion 28*a* of each bellows portion 28 has a diameter smaller than the outer diameter of the shielded wire 37, and therefore the shielded wire 37 is held in intimate contact with the mouth portion 28*a* to achieve a water-stop effect so that water, moving along the shielded wire 37, will not intrude into the interior of the grommet. A tape can be wound on the mouth portion 28*a* of each bellows portion 28 so as to further enhance the water-stop effect.

As described above, the shielded wires 37 in the present invention are connected to the motor 34 installed under the floor of the electric car, and therefore are less liable to be adversely affected by water as compared with shielded wires connected to an actuator within an engine room. Aside from this, a gap between the shield shell 25 and the earth cover 34, as well as a gap between each shielded wire and the earth cover 34*c*, is completely sealed, and therefore the connected portion between each shielded wire 37 and the corresponding joint terminal 10, 15, the connected portion between each shielded wire 37 and the corresponding LA terminal 20 and the connected portion between each LA terminal 20 and the motor 34 are positively protected in a waterproof manner, so that the reliability of the electrical connection is enhanced.

Next, the modified example of this embodiment will be described with reference to FIG. 4. Identical constituent portions to the joint terminals 10 and 15 of FIGS. 1 to 3 will be designated by identical reference numerals, respectively, and explanation thereof will be omitted. In this modified example, the efficiency of an operation for connecting shielded wires 37 can be enhanced, and terminal mounting portions 12 and 17 of joint terminals 10' and 15' are superposed together, with passage holes 12*a* and 17*a* communicating with each other, and are fastened together to a grounding portion 14 of an earth cover 34 by a fastening bolt 19 passing through the passage holes 12*a* and 17*a*. As a result, braids 37*c* of the shielded wires 37 are connected for grounding purposes to the grounding portion 14, and after conductors 37*a* of the shielded wires 37 are connected respectively to electrode portions 34 of a motor 34, a shield shell 25 can be mounted to cover the motor 34, and therefore the connection of the shielded wires 37 can be effected easily.

Like the joint terminals 10 and 15 shown in FIG. 3 and other Figures, each of the joint terminals 10' and 15' is formed by folding a blanked-out sheet piece (in a developed condition) double and then by bending it, thereby providing an integral construction. A wire connection portion 13, 18 of a tubular shape is formed at one end of each joint terminal 10', 15' while the terminal mounting portion 12, 17, having the passage hole 12*a*, 17*a*, is formed at the other end thereof.

A hole for the passage of a shank portion of the fastening bolt 19 is formed through the grounding portion 14, and a female screw portion 14*b* is formed on and projects downwardly from a peripheral edge of this hole. With this construction, it is not necessary to provide a nut at the reverse side of the earth cover 34*c* when the joint terminals 10' and 15' are to be bolt-fastened to the grounding portion 14, and this also enhances the efficiency of the operation for connecting the shielded wires 37.

An operation space b, required for the bolt-fastening operation, is generally equal to the operation space a shown in FIG. 3, and the terminal mounting portions 12 and 17 of the joint terminals 10' and 15' can be fastened by the bolt in the narrow limited space.

Next, the second embodiment of the invention will be described with reference to FIG. 5. This embodiment is provided in that retaining step portions (retaining portions) 42*d* are formed at a terminal mounting portion 42 (which is one of two terminal mounting portions 42 and 47 to be superposed together), while engagement step portions (engagement portions) 47*d* for engagement respectively with the retaining step portions 42*d* are formed at the other terminal mounting portion 47.

Each of joint terminals 40 and 46 is formed by blanking a piece from an electrically-conductive sheet and then by bending it into a predetermined shape, thereby providing an integral construction. These joint terminals differ from the joint terminals 10, 15, 10' and 15' of FIGS. 3 and 4 in that the blanked-out sheet piece in a developed condition is not folded double, but is bent from its developed condition into the predetermined shape. The joints terminals 40 and 46 further differ from the joint terminals 10, 15, 10' and 15' of FIGS. 3 and 4 in that a wire connection portion 41 for being press-fastened around a braided wire 37*c* of a shielded wire 37 is formed at one end of each of the joint terminals 40 and 46 and that the terminal mounting portions 42 and 47 which are adapted to be combined together in biting relation to each other are formed respectively at the other ends of the joint terminals 42 and 47.

The wire connection portion 41 has a tubular wall 41*a* which is curved into a generally round shape, and the tubular wall 41*a* is wound around the braided wire 37*c*, and therefore even when the shielded wire 37 of a different size or diameter is used, the wire connection portion 41 can be firmly press-fastened on the shielded wire 37. Therefore, the braided wire 37*c* and the wire connection portion 41 are contacted with each other in a good condition, so that the contact reliability is enhanced, and also the withdrawal of the shielded wire 37 from the wire connection portion by a pulling force due to vibrations of the car or others is prevented.

The one terminal mounting portion 42 includes a passage hole 42*a* of a generally rectangular shape, base plate portions 42*b* and 42*c* disposed respectively on opposite sides of the passage hole 42*a*, the pair of retaining step portions 42*d* and 42*d* which are formed between the two base plate portions 42*b* and 42*c*, and project upwardly in a direction of the thickness of these base plate portions, and a retaining piece portion 42*e* formed at the base plate portion 42*c*. The other terminal mounting portion 47 is so shaped as to be brought into biting engagement with the one terminal mounting portion 42, and this terminal mounting portion 47 includes a passage hole 47*a* of a generally rectangular shape, base plate portions 47*b* and 47*c* disposed respectively on opposite sides of the passage hole 47*a*, the pair of engagement step portions 47*d* and 47*d* which are formed between the two base plate portions 47*b* and 47*c*, and project downwardly in a direction of the thickness of these base plate portions, and a retaining groove 47*e* formed in the base plate portion 47*c*.

Each retaining step portion 42*d* and each engagement step portion 47*d* project respectively in opposite directions, and the base plate portions 42*b*, 42*c*, 47*b* and 47*c* are flat. Therefore, the two terminal mounting portions 42 and 47 can be superposed together, with no gap formed therebetween. When the two terminal mounting portions 42 and 47 are brought into biting engagement with each other, the retaining piece portion 42*e* of the one terminal mounting portion 42 is engaged in the retaining groove 47*e* in the other terminal mounting portion 47, thereby locking the two terminal mounting portions 42 and 47 to each other. The upper and lower passage holes 42*a* and 47*a* communicate with each other, and a fastening bolt 19 is passed through the passage holes 42*a* and 47*a*, and a nut 45 is threaded on this fastening bolt 19, so that the upper and lower terminal mounting portions 42 and 47 are completely fastened to a shield shell 25.

The other construction of the connecting structure for the shielded wires 37 is generally similar to that of the connecting structure of FIGS. 1 to 3, and therefore explanation thereof will be omitted.

In this embodiment, the terminal mounting portions 42 and 47 of the joint terminals 40 and 46 are beforehand combined together before the shielded wires 37 are connected to a motor 34, and therefore it is not necessary to effect the bolt-fastening operation while superposing the terminal mounting portions 42 and 47 of the joint terminals 40 and 46 together, with the passage holes 42*a* and 47*a* communicating with each other, and therefore the joint terminals 40 and 46 can be easily connected for grounding purposes to the shield shell 25. And besides, the fastening bolt 19 is prevented from being loosened by vibrations of the car and others, and therefore the joint terminals 40 and 46 are prevented from being disengaged from the shield shell.

The present invention is not limited to the above embodiments, and various modifications can be made without departing from the subject matter of the invention. The connecting structures of the invention for the shielded wires 37 can applied also to a shield connector.

What is claimed is:

1. A shielded wire-connecting structure comprising:

a joint terminal including a wire connection portion formed at one end thereof so as to be connected to a braided wire and a terminal mounting portion formed at the other end thereof so as to be connected to a grounding portion;

a passage hole for the passage of a fastening member therethrough formed through said terminal mounting portion, wherein said terminal mounting portions of a plurality of said joint terminals are superposed together with said passage holes communicating with each other, and are fastened together to said grounding portion by said fastening member passing through said passage holes.

2. A shielded wire-connecting structure as claimed in claim 1, wherein said grounding portion includes a shielding cover.

3. A shielded wire-connecting structure according to claim 1, wherein one of said terminal mounting portions which are to be superposed together includes a retaining portion, and the other terminal mounting portion includes an engagement portion for engagement with said retaining portion.

4. A shielded wire-connecting structure according to claim 1, wherein said joint terminal is bent into a generally L-shape.

* * * * *